US008240150B2

(12) United States Patent
Varatharajan et al.

(10) Patent No.: US 8,240,150 B2
(45) Date of Patent: Aug. 14, 2012

(54) LEAN DIRECT INJECTION DIFFUSION TIP AND RELATED METHOD

(75) Inventors: Balachandar Varatharajan, Cincinnati, OH (US); Willy S. Ziminsky, Simpsonville, SC (US); John Lipinski, Simpsonville, SC (US); Gilbert O. Kraemer, Greer, SC (US); Ertan Yilmaz, Niskayuna, NY (US); Benjamin Lacy, Greer, SC (US)

(73) Assignee: General Electric Company, Schenectady, NY (US)

( * ) Notice: Subject to any disclaimer, the term of this patent is extended or adjusted under 35 U.S.C. 154(b) by 1041 days.

(21) Appl. No.: 12/222,423

(22) Filed: Aug. 8, 2008

(65) Prior Publication Data

US 2010/0031661 A1 Feb. 11, 2010

(51) Int. Cl.
*F02C 1/00* (2006.01)
*F02G 3/00* (2006.01)

(52) U.S. Cl. ..... 60/737; 60/740; 60/742; 60/748

(58) Field of Classification Search ..... 60/737, 60/740, 742, 748, 746, 747
See application file for complete search history.

(56) References Cited

U.S. PATENT DOCUMENTS 3,980,233 A * 9/1976 Simmons et al. ..... 239/400
5,174,504 A * 12/1992 Halvorsen ..... 239/410
5,490,389 A * 2/1996 Harrison et al. ..... 60/737
5,505,045 A * 4/1996 Lee et al. ..... 60/748
5,511,375 A * 4/1996 Joshi et al. ..... 60/39.463
5,685,139 A 11/1997 Mick et al.
5,701,732 A * 12/1997 Nesbitt et al. ..... 60/776
5,761,907 A * 6/1998 Pelletier et al. ..... 60/740
5,826,429 A 10/1998 Beebe et al.
5,850,731 A 12/1998 Beebe et al.
6,047,550 A 4/2000 Beebe
6,073,436 A * 6/2000 Bell et al. ..... 60/39.094
6,076,356 A * 6/2000 Pelletier ..... 60/740
6,192,688 B1 2/2001 Beebe
6,622,488 B2 * 9/2003 Mansour et al. ..... 60/740
6,698,207 B1 3/2004 Wiebe et al.
6,772,594 B2 8/2004 Nishida et al.
6,786,046 B2 9/2004 Wiebe et al.
6,848,260 B2 2/2005 North et al.
6,868,676 B1 3/2005 Haynes
6,945,051 B2 9/2005 Benelli et al.
6,968,692 B2 11/2005 Chin et al.
6,996,991 B2 2/2006 Gadde et al.
7,117,679 B2 * 10/2006 Toon et al. ..... 60/740
7,127,899 B2 10/2006 Sprouse et al.
7,137,258 B2 11/2006 Widener
(Continued)

*Primary Examiner* — William H Rodriguez
(74) *Attorney, Agent, or Firm* — Nixon & Vanderhye, P.C.

(57) ABSTRACT

A nozzle for a gas turbine combustor includes a first radially outer tube defining a first passage having an inlet and an outlet, the inlet adapted to supply air to a reaction zone of the combustor. A center body is located within the first radially outer tube, the center body including a second radially intermediate tube for supplying fuel to the reaction zone and a third radially inner tube for supplying air to the reaction zone. The second intermediate tube has a first outlet end closed by a first end wall that is formed with a plurality of substantially parallel, axially-oriented air outlet passages for the additional air in the third radially inner tube, each air outlet passage having a respective plurality of associated fuel outlet passages in the first end wall for the fuel in the second radially intermediate tube. The respective plurality of associated fuel outlet passages have non-parallel center axes that intersect a center axis of the respective air outlet passage to locally mix fuel and air exiting said center body.

12 Claims, 5 Drawing Sheets

U.S. PATENT DOCUMENTS

| | | | | |
|---|---|---|---|---|
| 7,185,494 | B2 | 3/2007 | Ziminsky et al. | |
| 7,284,378 | B2 | 10/2007 | Amond, III et al. | |
| 7,412,833 | B2 * | 8/2008 | Widener | 60/772 |
| 7,506,496 | B2 * | 3/2009 | Mantchenkov et al. | 60/39.461 |
| 7,540,154 | B2 * | 6/2009 | Tanimura et al. | 60/742 |
| 7,546,735 | B2 * | 6/2009 | Widener | 60/746 |
| 7,658,074 | B2 * | 2/2010 | Tuttle | 60/737 |
| 7,661,269 | B2 * | 2/2010 | Bonzani et al. | 60/748 |
| 7,694,521 | B2 * | 4/2010 | Ohta et al. | 60/748 |
| 7,779,636 | B2 * | 8/2010 | Buelow et al. | 60/742 |
| 7,921,650 | B2 * | 4/2011 | Oda et al. | 60/748 |
| 8,015,815 | B2 * | 9/2011 | Pelletier et al. | 60/740 |
| 8,015,816 | B2 * | 9/2011 | Hall | 60/740 |
| 8,104,284 | B2 * | 1/2012 | Miura et al. | 60/746 |
| 2005/0188703 | A1 | 9/2005 | Sprouse et al. | |
| 2007/0089425 | A1 | 4/2007 | Motter et al. | |
| 2008/0078160 | A1 | 4/2008 | Kraemer et al. | |

* cited by examiner

LEAN DIRECT INJECTION DIFFUSION TIP AND RELATED METHOD

This invention was made with Government support under Contract No. DE-FC26-05NT42643 awarded by the Department of Energy. The Government has certain rights in the invention.

This invention relates generally to turbine combustion and more particularly, to a lean direct injection nozzle for achieving lower $NO_x$ emissions.

BACKGROUND OF THE INVENTION

At least some known gas turbine engines combust a fuel air mixture to release heat energy from the mixture to form a high temperature combustion gas stream that is channeled to a turbine via a hot gas path. The turbine converts thermal energy from the combustion gas stream to mechanical energy that rotates a turbine shaft. The output of the turbine may be used to power a machine, for example, an electric generator, pump, or the like.

At least one by-product of the combustion reaction may be subject to regulatory limitations. For example, within thermally driven reactions, nitrogen oxide ($NO_x$) may be formed by a reaction between nitrogen and oxygen in the air initiated by the high temperatures within the gas turbine engine. Generally, engine efficiency increases as the combustion gas stream temperature entering a turbine section of the gas engine increases; however, increasing the combustion gas temperature may facilitate an increased formation of undesirable $NO_x$.

Combustion normally occurs at or near an upstream region of a combustor that is normally referred to as the reaction zone or the primary zone. Inert diluents may be introduced to dilute the fuel and air mixture to reduce peak temperatures and hence $No_x$ emissions. However, inert diluents are not always available, may adversely affect an engine heat rate, and may increase capital and operating costs. Steam may be introduced as a diluent but may also shorten the life expectancy of the hot gas path components.

In an effort to control $NO_x$ emissions during turbine engine operation, at least some known gas turbine engines use combustors that operate with a lean fuel/air ratio and/or with fuel premixed with air prior to being admitted into the combustor's reaction zone. Premixing may facilitate reducing combustion temperatures and hence $NO_x$ formation without requiring diluent addition. However, if the fuel used is a process gas or a synthetic gas, there may be sufficient hydrogen present such that an associated high flame speed may facilitate autoignition, flashback, and/or flame holding within a mixing apparatus. Premix nozzles also have reduced turndown margin since very lean flames can blow out.

To extend turndown capability, premix nozzles are employed which utilize a diffusion tip to inject fuel for start-up and part-load conditions. A diffusion tip is typically attached to the center body of the premix nozzle. Syngas combustors also use stand-alone diffusion nozzles to burn a variety of different fuels to prevent flame holding/flashback with high hydrogen fuels and blow out with low Wobbe index fuels. A shortcoming in these systems is high $NO_x$ levels when running in pilot or piloted premix mode. Currently, co-flow diffusion tips are utilized to provide pilot flames for stability, turn down capability and fuel flexibility. This arrangement, however, also results in high $NO_x$.

A lean direct injection (LDI) method of combustion is typically defined as an injection scheme that injects fuel and air into a combustion chamber of a combustor with no premixing of the air and fuel prior to injection similar to traditional diffusion nozzles. However, this method can provide improved rapid mixing in the combustion zone resulting in lower peak flame temperatures than found in traditional non-premixed, or diffusion, methods of combustion and hence, lower $NO_x$ emissions

BRIEF DESCRIPTION OF THE INVENTION

In one aspect, a novel LDI nozzle for a gas turbine combustor is provided. The nozzle comprises a first radially outer tube defining a first passage having an inlet and an outlet, the inlet adapted to supply air to a reaction zone of the combustor; a center body within the first radially outer tube, the center body comprised of a second radially intermediate tube for supplying fuel to the reaction zone and a third radially inner tube for supplying air to the reaction zone; wherein the second intermediate tube has a first outlet end closed by a first end wall that is formed with a plurality of substantially parallel, axially-oriented air outlet passages for the additional air in the third radially inner tube, each air outlet passage having a respective plurality of associated fuel outlet passages in the first end wall for the fuel in the second radially intermediate tube, and further wherein the respective plurality of associated fuel outlet passages have non-parallel center axes that intersect a center axis of the respective air outlet passage adapted to locally mix fuel and air exiting the center body.

In another aspect, a nozzle for a gas turbine combustor is provided comprising: a first radially outer tube defining a first passage having an inlet and an outlet, the inlet adapted to supply air to a reaction zone of the combustor; a center body within the first radially outer tube, the center body comprised of a second radially intermediate tube for supplying fuel to the reaction zone, and a third radially inner tube for supplying air to the reaction zone; and means for mixing the fuel and the additional air locally, adjacent the outlet end of the center body.

In still another aspect, a method of operating a turbine engine is provided. The method includes the steps of: providing at least one nozzle for supplying fuel and air to a reaction zone of a combustor, the nozzle comprising a first radially outer tube defining a first passage having an inlet and an outlet, the inlet adapted to supply premix air to the reaction zone; a center body within the first radially outer tube, the center body comprised of a second radially intermediate tube having a downstream tip within the first radially outer tube for supplying fuel to the reaction zone and a third radially inner tube for supplying additional air to the reaction zone; and, causing fuel flow from the second radially intermediate tube to intersect and mix with additional air flow from the third radially inner tube substantially immediately upon exiting the center body.

The invention will now be described in detail in connection with the drawings identified below.

DETAILED DESCRIPTION OF THE INVENTION

Figure 1:
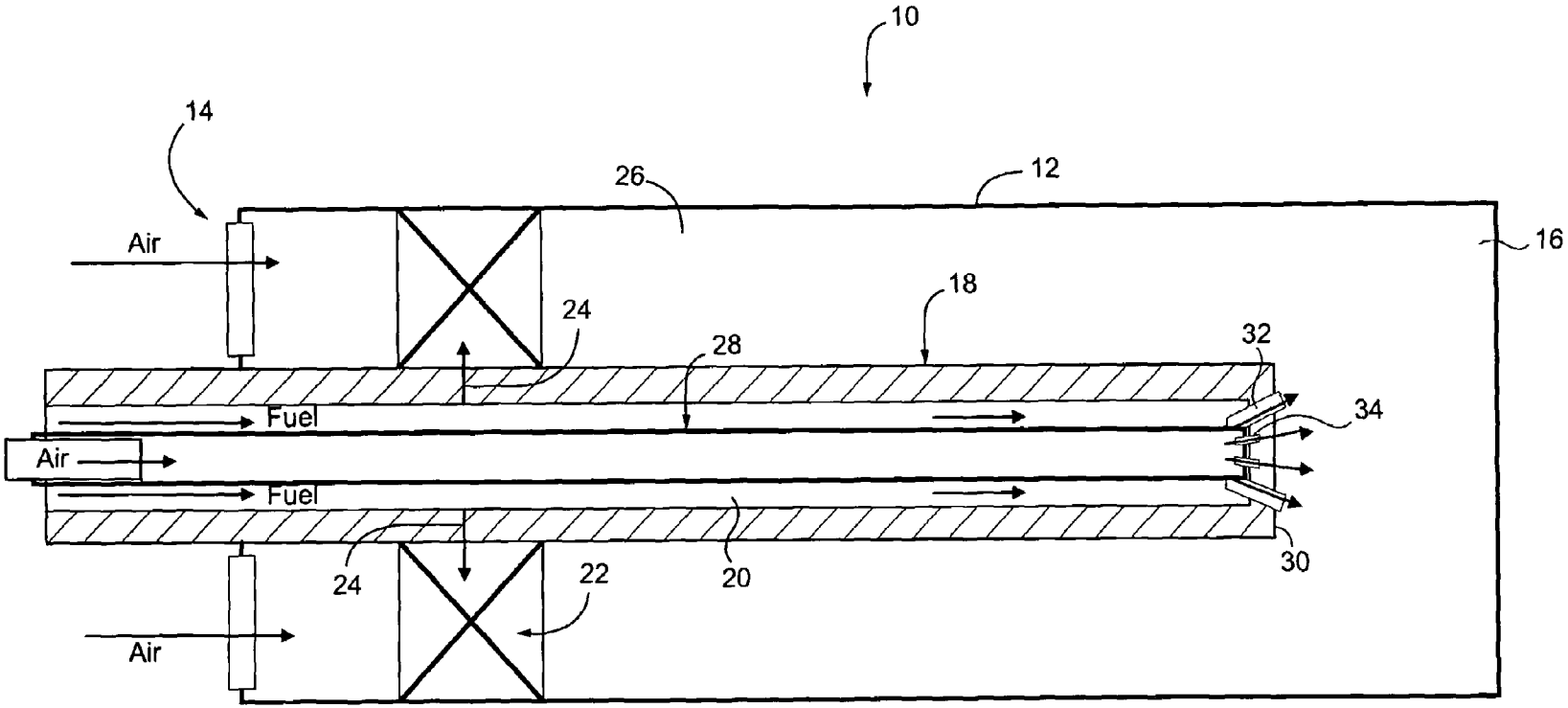
Figure 1 (Prior Art)
FIG. 1 is a schematic representation of a conventional premix nozzle with a diffusion tip.

With reference to FIG. 1, a known DLN (dry, low $NO_x$) premix nozzle 10 with a diffusion tip for pilot and piloted premix is shown. The nozzle 10 is formed with a radially outer wall 12 having an air inlet 14 and an outlet 16. A center body 18 extends into the nozzle and is positioned along the longitudinal center axis of the nozzle. The center body 18 defines a fuel passage 20 that supplies some portion of fuel to a fuel premix injection ring 22 that surrounds the center body 18 and extends radially between the center body and the radially outer wall 12 of the nozzle. Fuel can thus be introduced into the radially outer air passage 26 via radial fuel passage 24, thus premixing the fuel and air upstream of the combustor reaction zone. The remaining fuel flows along passage 20, exiting at the downstream center body tip as described in greater detail below.

The center body 18 is also provided with an inner tube 28 for supplying air to the center body tip. The downstream or outlet end of the center body 18 has a closed-end wall or tip 30 with respective annular arrays of fuel outlet orifices 32 and air outlet orifices 34. In this known arrangement, the orifices 32, 34 are angled outwardly relative to the longitudinal axis, so as to mix with the premix air flowing in the radially outer passage 26. Note, however, that flow paths of the fuel and air exiting the orifices 32, 34 do not intersect and thus no local intermixing of the fuel and air occurs at the center body tip.

Figure 2:
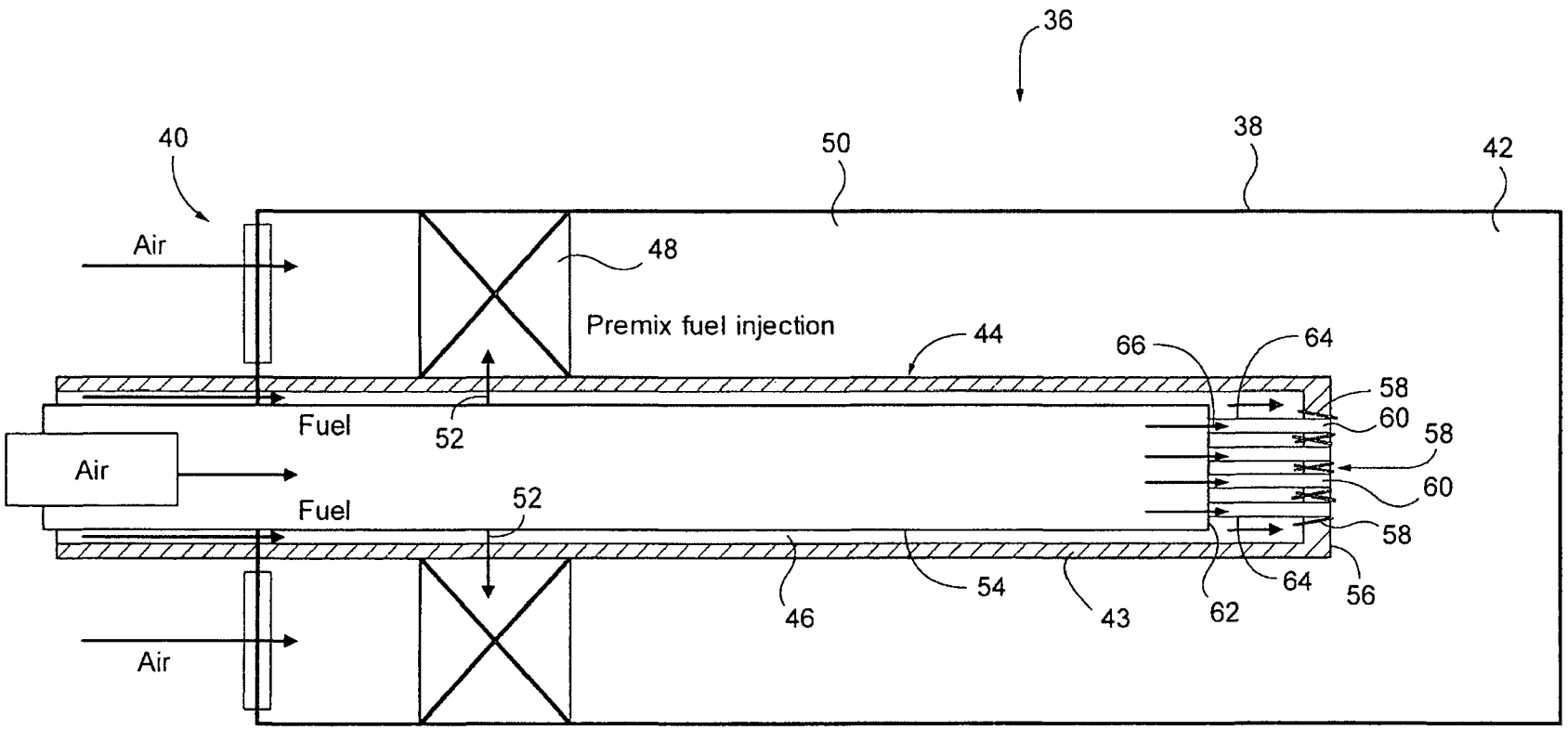
FIG. 2 is a schematic representation of a lean direct injection nozzle in accordance with a first exemplary but nonlimiting embodiment of the subject invention.

FIG. 2 illustrates an exemplary but non-limiting embodiment of an LDI nozzle 36 in accordance with this invention. As in the known nozzle construction described above, the nozzle 36 is formed with a radially outer wall 38 (or first radially outer tube) having an air inlet 40 and an outlet 42. A center body 43 includes a second radially intermediate tube 44 that extends into the nozzle and is positioned along the longitudinal center axis of the nozzle. The tube 44 defines an annular fuel passage 46 that supplies some portion of fuel to a radially oriented fuel premix injection ring 48 that surrounds the center body 43 and extends radially between the center body 43 and the radially outer wall 38. Fuel is introduced into a radially outer air passage 50 via radial fuel passages 52, for premixing fuel and air in the passage 50 upstream of the combustion chamber reaction zone. The remaining fuel flows along passage 46 to the center body tip.

Figure 3:
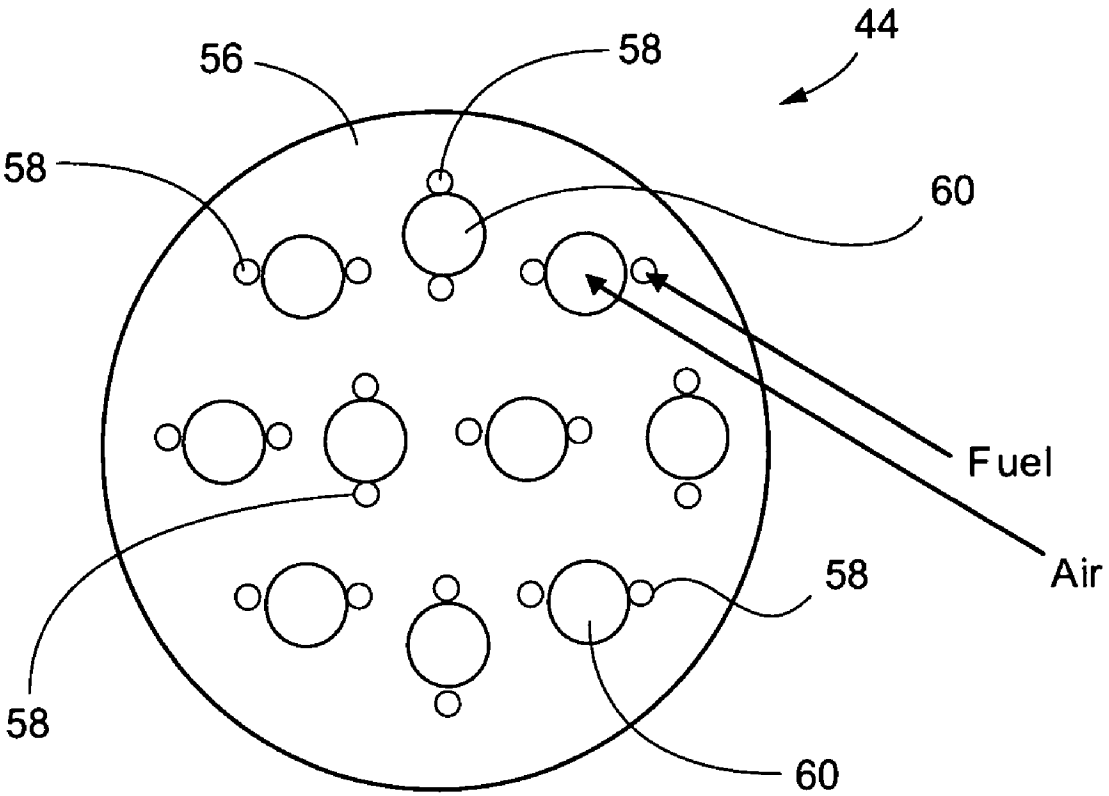
FIG. 3 is an elevation of the center body tip portion of the nozzle shown in FIG. 2.

The center body 43 is also provided with a third radially inner tube 54 for supplying air to the center body tip. Tube 54, like tube 28, lies on the center or longitudinal axis of the nozzle, i.e., the tube pairs 18, 28 and 44, 54, respectively, are concentrically arranged. The downstream end or tip of the center body 43 has a closed-end wall or tip 56 formed with relatively smaller, angled fuel outlet orifices (or passages) 58 and relatively larger coaxial air outlet orifices (or passages) 60. In this exemplary embodiment, the radially inner air tube 54 has its own closed-end wall or tip 62 upstream of the end wall 56, with tubes 64 connecting air outlet orifices 66 of the inner air tube 54 with the air outlet orifices 60 in the end wall or tip 56. With reference also to FIG. 3, each air outlet orifice 60 directs airflow axially away from the center body, in a downstream direction, to the nozzle outlet 42. These air outlets could be angled tangentially if desired to impart swirl to the flow. Each air outlet orifice 60 has its own associated set of relatively smaller fuel outlet orifices 58, arranged at substantially diametrically opposite locations, the number and orientation set to maximize mixing while maintaining the desired fuel side pressure drop. In addition, each set of fuel outlet orifices 58 associated with a particular air outlet orifice 60, is arranged such that axes of the fuel outlet passages 58 intersect the center axis of the associated air outlet passage 60. In other words, each outlet flow of air via passages 60 at the tip 56 of the nozzle center body 44 is impinged upon, i.e., intersected, by fuel flows coming from diametrically opposed passages or orifices 58. This arrangement provides more rapid mixing of fuel and air at the center body tip 56 than in current diffusion-tip nozzles, and also better mixing with the premixed air and fuel in the air passage 50 to further reduce $NO_x$. The fuel outlet orifices could also be recessed some distance into the air orifices to provide some additional premixing.

Figure 4:
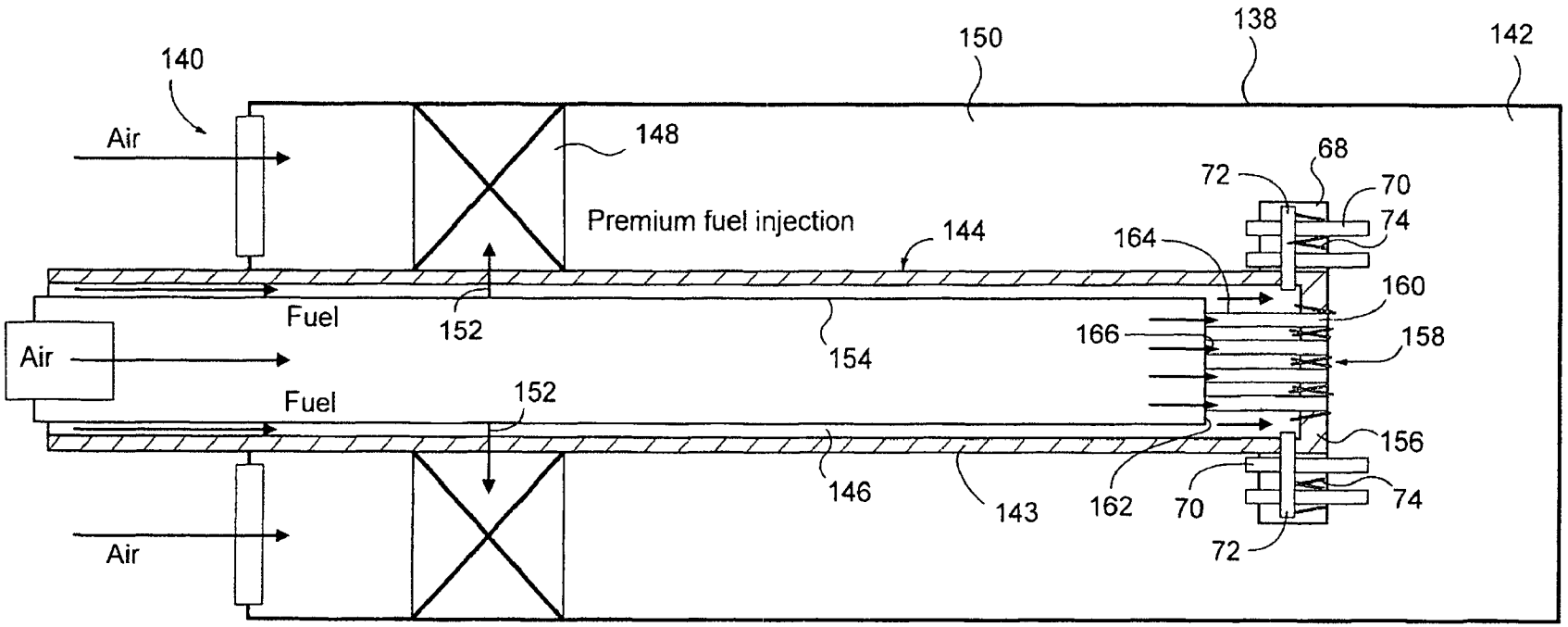
FIG. 4 is a schematic representation of a lean direct injection nozzle in accordance with a second exemplary but nonlimiting embodiment.
Figure 5:
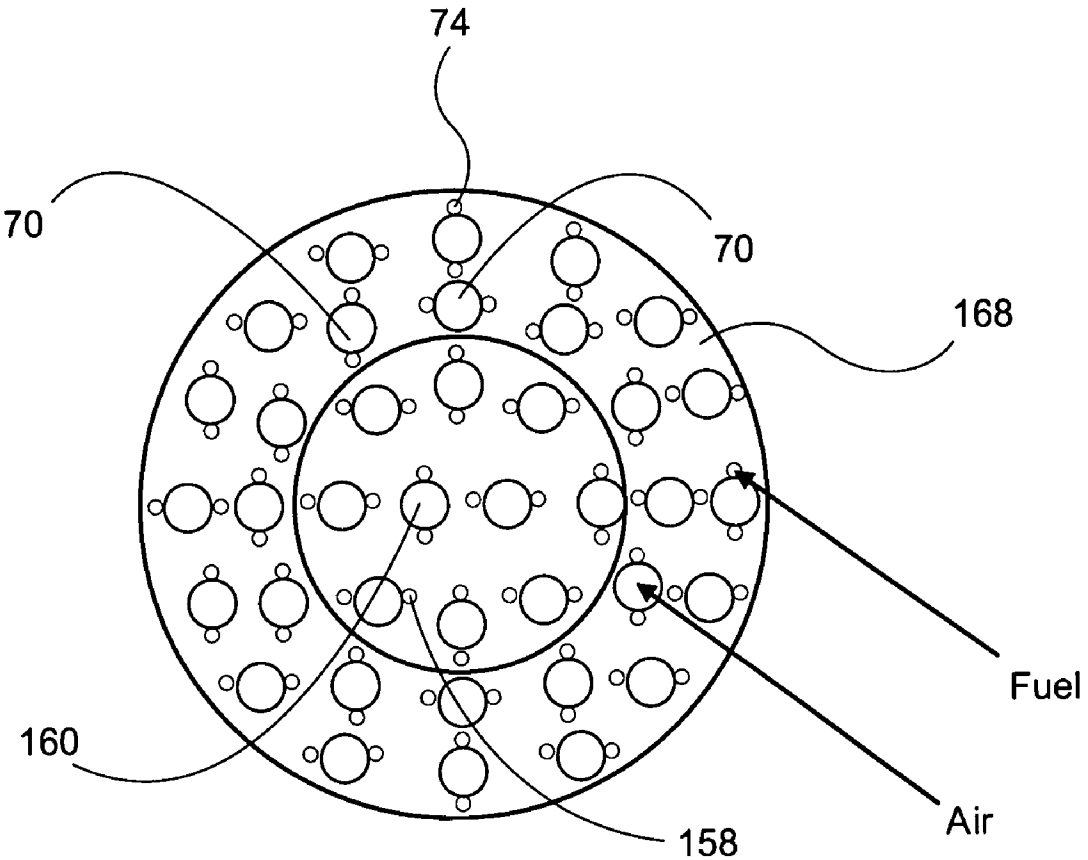
FIG. 5 is a front elevation of the center body tip portion of the nozzle shown in FIG. 4.

FIGS. 4 and 5 illustrate a variation of the nozzle configuration shown in FIGS. 3 and 4. Where applicable, similar reference numerals, but with the prefix "1" added, are employed in FIGS. 4 and 5 to refer to corresponding mechanical parts. Specific component parts not mentioned below can be assumed to be similar in both structure and operation to corresponding components shown and described in connection with FIGS. 2 and 3. Thus, in this variation, the closed end wall or tip 156 of the center body 143 is essentially radially extended beyond the center body by means of a ring 68 applied about the tip 156 of the center body outer tube 144. The extended portion or ring 68 is provided with plural, axially oriented air through-passages 70 that extend parallel to the center body 143 and are in communication with the radially outer air passage 150 of the nozzle. These air passages could be angled tangentially if desired to impart swirl to the flow. Plural fuel tubes/passages 72 extend radially outwardly from the center body fuel passage 146 into the ring 68, thus supplying fuel to plural angularly oriented (and relatively smaller diameter) fuel passages 74. The passages 74 are arranged to establish fuel flow paths that intersect the airflow through passages 70 so as to extend the local mixing of air and fuel beyond the diameter of the center body.

With reference to FIG. 5, it can be seen that the pattern of fuel and air orifices 158, 160 has been expanded to include a similar pattern in two radially outer annular rows of air passages 70 and fuel passages 74 via the annular ring 68, further enhancing the local mixing of air and fuel at the tip of the center body. As in FIG. 3, the arrangement is such that each air passage 70 has a set of associated fuel passages 74 at diametrically opposed locations, angled inwardly to intersect the air flow, the number and orientation set to maximize mixing while maintaining the desired fuel side pressure drop. The fuel outlet orifices could also be recessed some distance into the air orifices to provide some additional premixing. It will be appreciated however, that the number and arrangement of both the fuel and air passages may vary. It will be appreciated that in this example, some of the premix air in the passage 150 is diverted to supply the LDI center body 143, further reducing NO by allowing a leaner flame at the center body tip.

Thus, the exemplary implementations of the invention described herein may have beneficial results in terms of reduced $NO_x$, increased fuel flexibility and turndown capability, as well as additional flame stability/reduced dynamics.

It should be recognized that either the air or fuel passages designated here could have some combination of air, fuel, and diluent injected through them to improve operability/emissions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle for a gas turbine combustor comprising:

a first radially outer tube defining a first passage having an inlet and an outlet, said inlet adapted to supply premix air to a reaction zone of the combustor;

a center body within said first radially outer tube, said center body comprised of a second radially intermediate tube within said first radially outer tube for supplying fuel to the reaction zone and a third radially inner tube for supplying additional air to the reaction zone;

wherein said second intermediate tube has a first outlet end closed by a first end wall that is formed with a plurality of substantially parallel, axially-oriented air outlet passages for the additional air in the third radially inner tube, each air outlet passage having a respective plurality of associated fuel outlet passages in said first end wall for the fuel in the second radially intermediate tube, and further wherein said respective plurality of associated fuel outlet passages have non-parallel center axes that intersect a center axis of the respective air outlet passage adapted to locally mix fuel and air exiting said center body.

2. The nozzle of claim 1 wherein said respective plurality of associated fuel outlet passages comprise a set of fuel outlet passages located at substantially diametrically opposed locations relative to the respective fuel outlet passage.

3. The nozzle of claim 2 wherein the number and orientation of said set of fuel outlet passages is chosen to maximize said local mixing of fuel and air.

4. The nozzle of claim 1 wherein said radially inner tube has a second outlet end axially spaced from said first outlet end, said second outlet end closed by a second end wall formed with plural air tubes extending between said second outlet end and said first outlet end.

5. The nozzle of claim 4 including a fuel injector ring surrounding said center body and having passages for injecting fuel from said intermediate tube into the premix air flowing through said radially outer tube at a location upstream of said first outlet end.

6. The nozzle of claim 1 including a fuel injector ring surrounding said center body and having passages for injecting fuel from said intermediate tube into the premix air flowing through said radially outer tube at a location upstream of said first outlet end, forming said first group of air outlet passages.

7. The nozzle of claim 6 wherein said first outlet end extends radially beyond said center body, a radially extended portion thereof having through passages therein in communication with said first passage, each of said through passages diverting an amount of premix air in said first passage for additional mixing with fuel exiting said center body from said intermediate tube via angled fuel passages in said radially extended portion having center axes oriented to intersect center axes of said through passages.

8. A nozzle for a gas turbine combustor comprising:

a first radially outer tube defining a first passage having an inlet and an outlet, said inlet adapted to supply premix air to a reaction zone of the combustor;

a center body within said first radially outer tube, said center body comprised of a second radially intermediate tube for supplying fuel the reaction zone, and a third radially inner tube for supplying additional air to the reaction zone, said center body having an outlet end formed with plural fuel outlets and one or more air outlets for the additional air; and means for mixing the fuel and the additional air locally, adjacent the outlet end of the center body.

9. The nozzle of claim 8 including a fuel injector ring surrounding said center body and having passages for injecting fuel from said intermediate tube into the premix air flowing through said radially outer tube at a location upstream of said first outlet end.

10. The nozzle of claim 9 wherein said first outlet end extends radially beyond said center body, a radially extended portion thereof having through passages therein in communication with said first passage, each of said through passages diverting an amount of premix air in said first passage for additional mixing with fuel exiting said center body from said intermediate tube via angled fuel passages in said radially extended portion having center axes oriented to intersect center axes of said through passages.

11. A method of operating a gas turbine at start-up and part load conditions comprising:

providing at least one nozzle for supplying fuel and air to a reaction zone of a combustor, the nozzle comprising a first radially outer tube defining a first passage having an inlet and an outlet, said inlet adapted to supply premix air to the reaction zone;

a center body within said first radially outer tube, said center body comprised of a second radially intermediate tube having a downstream tip provided with plural fuel outlet passages within said first radially outer tube for supplying fuel to the reaction zone and a third radially inner tube for supplying additional air to the reaction zone via plural air outlet passages in said downstream tip; and causing fuel flow from the second radially intermediate tube to intersect and mix with additional air flow from the third radially inner tube substantially immediately upon exiting the center body.

12. The method of claim 11 including diverting a portion of the premix air to mix further with fuel from the second radially intermediate tube at the tip of the center body.

* * * * *